United States Patent [19]

Nichols

[11] Patent Number: 5,037,027

[45] Date of Patent: Aug. 6, 1991

[54] TOTE BOX CONSTRUCTION

[75] Inventor: Glenn R. Nichols, Wyoming, Mich.

[73] Assignee: Bradford Company, Holland, Mich.

[21] Appl. No.: 629,159

[22] Filed: Dec. 18, 1990

[51] Int. Cl.[5] ..... B65D 5/22

[52] U.S. Cl. ..... 229/198.1; 229/918; 229/DIG. 11; 206/512

[58] Field of Search ..... 229/918, DIG. 11, 198.1; 206/512

[56] References Cited

U.S. PATENT DOCUMENTS

| | | | |
|---|---|---|---|
| 329,875 | 11/1885 | Andrews . | |
| 1,383,499 | 7/1921 | Tisch . | |
| 1,656,161 | 1/1928 | Berndt . | |
| 1,684,898 | 9/1928 | Trautman . | |
| 2,009,527 | 7/1935 | Shelton . | |
| 2,138,424 | 11/1938 | McCuthen . | |
| 2,169,450 | 8/1939 | McCutchen . | |
| 2,339,445 | 1/1944 | Wynne et al. | 229/918 |
| 2,496,965 | 2/1950 | Swingle . | |
| 2,634,021 | 4/1953 | Cella . | |
| 2,652,174 | 9/1953 | Shea et al. . | |
| 3,220,633 | 11/1965 | Swane . | |
| 3,226,008 | 12/1965 | Chiorri . | |
| 3,246,826 | 4/1966 | Clemens . | |
| 3,315,835 | 4/1967 | Katzman | 206/512 |
| 3,368,736 | 2/1968 | McKellick . | |
| 3,397,831 | 8/1968 | Adams | 229/918 |
| 3,406,893 | 10/1968 | Swane | 229/198.1 |
| 4,126,265 | 11/1978 | Holmes . | |
| 4,595,137 | 6/1986 | Kupersmit | 229/918 |
| 4,779,751 | 10/1988 | Munroe . | |
| 4,787,553 | 11/1988 | Hoskins . | |
| 4,799,620 | 1/1989 | Vilella . | |

FOREIGN PATENT DOCUMENTS

| | | | |
|---|---|---|---|
| 2804406 | 8/1979 | Fed. Rep. of Germany | 229/DIG. 11 |
| 2188036 | 9/1987 | United Kingdom | 229/918 |

*Primary Examiner*—Stephen Marcus
*Assistant Examiner*—Christopher McDonald
*Attorney, Agent, or Firm*—Wood, Herron & Evans

[57] ABSTRACT

An improved tote box construction is disclosed which incorporates into the corners of a tote box during the assembly thereof corner enhancer structural elements which do not require any mechanical fasteners such as rivets or the like to secure the corner structural elements.

7 Claims, 1 Drawing Sheet

TOTE BOX CONSTRUCTION

BACKGROUND OF THE INVENTION

1. Field of the Invention

The present invention relates generally to stackable tote boxes and particularly to a corner-strengthening method of construction of tote boxes.

2. Description of the Prior Art

It is conventional to use returnable/reusable containers for the transportation of goods in commerce. Such containers, or so-called tote boxes, must be of a sufficiently stiff construction so as to be able to safely transport the goods contained therein without damage thereto. Furthermore, these tote boxes are frequently designed so as to be stackable for ease of transportation of a number of tote boxes. In order to be stackable, the corners of the tote boxes are typically reinforced and are utilized as the contact points between two stacked boxes.

It is also conventional to reinforce the corners of the tote boxes sufficiently such that the lowermost tote box of a stack of tote boxes can adequately support the load of the stacked tote boxes and goods therein without deformation of that lowermost tote box and resulting damage to the goods therein. Typically these strengthened tote box corners require an additional structural element residing within the corner, and additional fasteners such as rivets or the like to secure the corner structural element to the box corner itself. These additional fasteners add material costs and manufacturing steps to the tote box thereby resulting in a more expensive tote box.

It has therefore been one object of the present invention to provide for a tote box corner stiffening structural element which can be incorporated into the tote box corner during the assembly operation but which does not require any additional fasteners such as rivets or the like to secure the stiffening element to the tote box.

Another object of the present invention has been to reduce the total number of mechanical fasteners used in the construction of a tote box.

A further object of the present invention has been to reduce the amount of time required to assemble a tote box.

SUMMARY OF THE INVENTION

The present invention is an open or closed with cover top tote box used for transporting relatively heavy goods. The tote box is assembled from a box blank which, when folded into the appropriate shape, results in a bottom, two end walls, two side walls and four end flaps which are extensions of the side walls and which are folded about the end walls. The end walls and end flaps have holes into which are inserted reinforcing hand holds, to aid in manual movement of a loaded tote box.

Four structural angle corner enhancers reside within each corner of the tote box to stiffen the tote box corners and to provide a load path for the weight of the stacked tote boxes and their contents to be distributed downwardly to the lower corners of the tote box, outwardly and through to the supporting surface. A corner enhancer is inserted into each inside corner of the box such that one leg of the structural angle is sandwiched between the end wall and the end flap and a second leg of the structural angle resides against the inside surface of the side wall.

Once the box blank has been folded and the corner enhancer structural angles have been inserted within the corners of the box, structural channel reinforcement rails are then applied to the top edges of the box sides and box ends. The structural channels which fit over the edges of the box sides encase the box sides at their uppermost edges. The structural channels which fit over the edges of the box ends encase the end flaps and the box ends at their uppermost edges.

Stacking lug structural corners are next inserted over each corner of the tote box thereby encasing the reinforcement rail structural channels, the box sides, ends and end flaps.

Lastly, mechanical fasteners are attached through the stacking lug structural corners, thereby piercing and binding together the structural lug corners to the reinforcement rail structural channels and the box sides, ends and end flaps. The corner enhancer structural angles are of such a length that a fastener piercing a stacking lug structural corner does not pierce a corner enhancer structural angle. Since one leg of each corner enhancer structural angle is securely sandwiched between a box end and an end flap, there is no need to apply mechanical fasteners through the box and the corner enhancer structural angles.

One advantage of the present invention is that a tote box can be assembled rapidly without the need for intermediate fastener joining steps.

Another advantage of the present invention is that the number of fasteners for each tote box corner and hence per tote box has been reduced since there is no need to use fasteners to bind the corner enhancer to the tote box corners.

Yet another advantage of the present invention is that a stackable tote box may be constructed less expensively and more quickly than is presently accomplished in the industry.

These and other objects and advantages of the present invention will more readily become apparent as the following Figures are described, in which:

DESCRIPTION OF THE PREFERRED EMBODIMENTS

Figure 2:
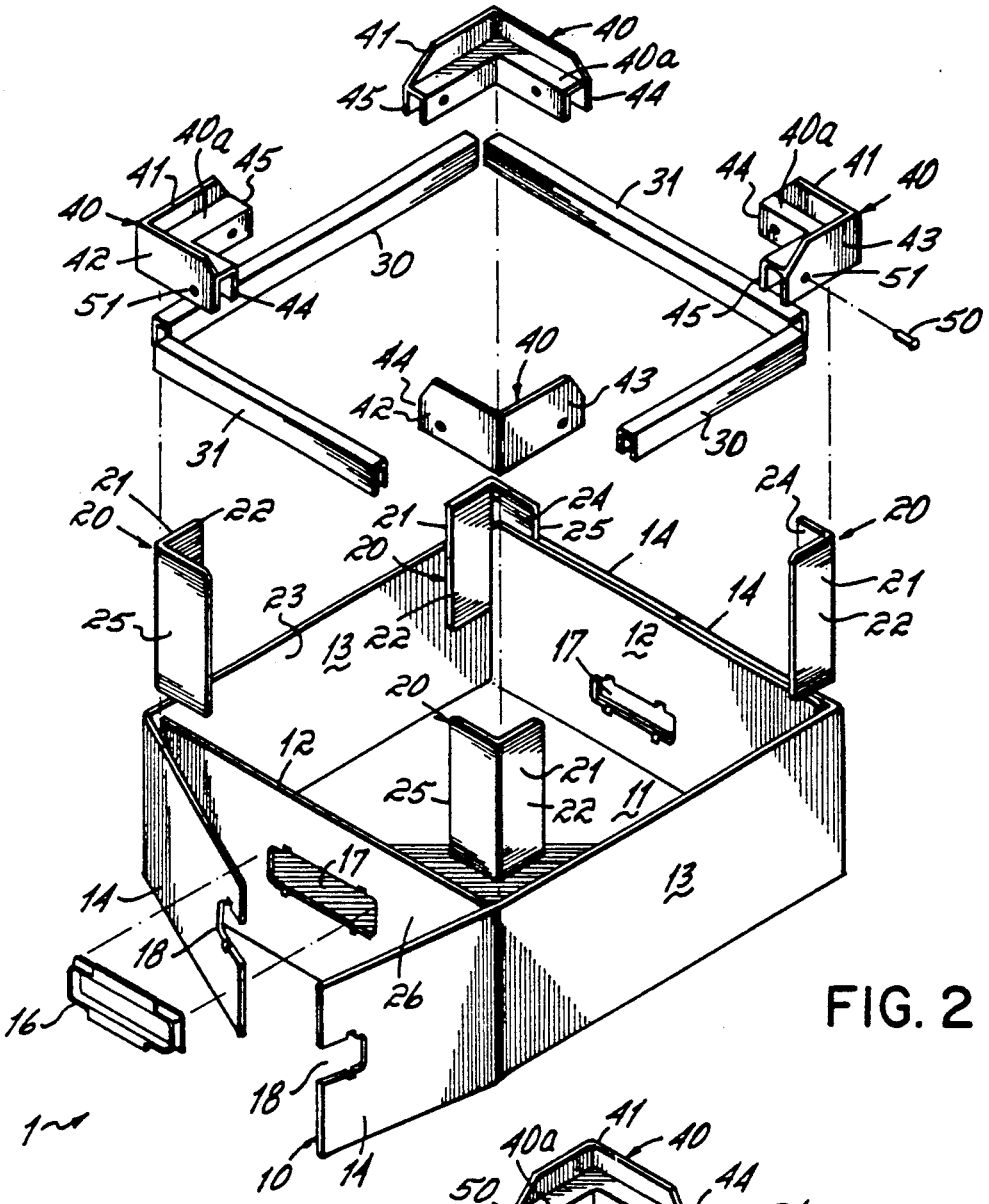
FIG. 2 is an exploded perspective view of the tote box of FIG. 1.
Figure 1:
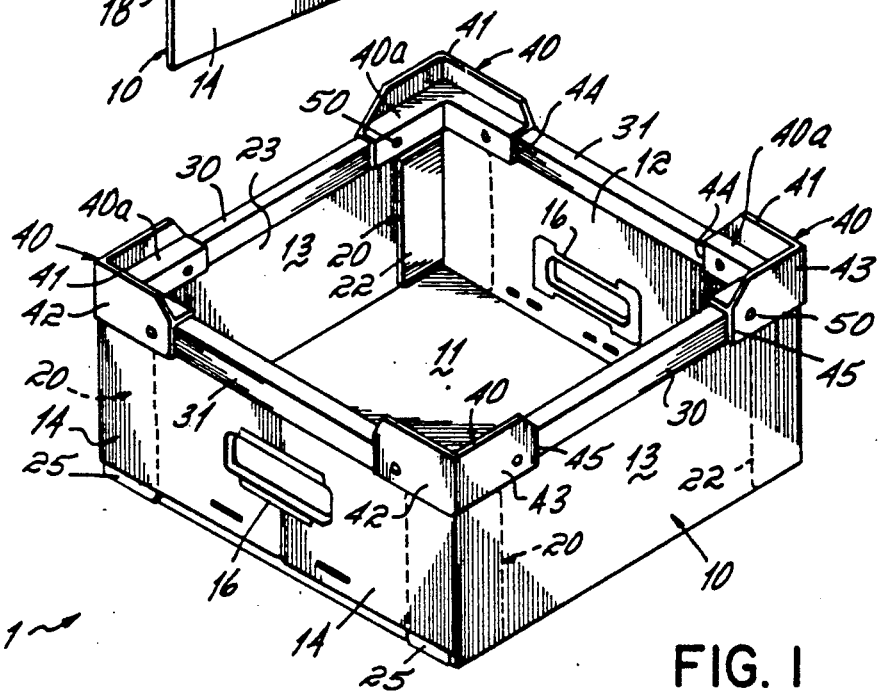
FIG. 1 is a perspective view of an assembled tote box embodying the present invention.

Referring to the Figures, a tote box 1 is illustrated which embodies the invention which is the subject of this application. Tote box 1 is assembled from a box blank 10 which is stamped out of or otherwise pre-cut from, preferably, corrugated plastic board. The box blank 10 has a box bottom 11, box ends 12, box sides 13, and box end flaps 14 which are extensions of box sides 13.

Four corner enhancer structural angles 20 are used in the construction of the tote box 1. These corner enhancer structural angles 20 are preferably made of plastic or aluminum. Each corner enhancer structural angle 20 has two equal length legs 22 and 25 which are substantially normal one to another.

Four reinforcement rail structural channels 30, 30, 31 and 31 are used in the construction of the tote box 1.

These reinforcement rail structural channels 30, 30, 31 and 31 are preferably made of plastic or aluminum.

Four stacking lug structural corners 40 are used in the construction of the tote box 1. These stacking lug structural corners 40 are preferably made of plastic or aluminum. These stacking lug structural corners 40 are essentially L-shaped channel sections, with an exterior lip 41 extending upwardly from the corners 40 and being coplanar with the outermost sides 42 and 43 of the corners 40. These lips 41 provide a means for locating a tote box 1 atop the surfaces 40*a* of the corners 40.

To assemble the tote box 1, the box ends 12 are first folded upwards. Next box sides 13 are folded upwards. A corner enhancer structural angle 20 is then inserted into each corner of the box blank 10 such that the outside surface 21 of structural angle leg 22 which is parallel to box side 13 is adjacent the inside surface 23 of that box side 13. The inside surface 24 of the structural angle leg 25 which is parallel to box end 12 is adjacent the outside surface 26 of that box end 12.

Next, box end flaps 14 are folded inwards, thereby sandwiching structural angle legs 25 between box ends 12 and box end flaps 14. Ends 12 and end flaps 14 have holes into which are inserted hand holds 16. End holes 17 are generally rectangular, and each end flap 14 contains an end flap hole 18 which is essentially one-half of an end hole 17 such that when complimenting end flaps 14 are folded against an end 12 a hole identical in size to an end hole 17 is generated whereupon a hand hold 16, preferably fabricated of plastic or aluminum, may be inserted therein.

To secure the box blank 10 with the corner enhancer structural angles 20 therein, the side reinforcement rail structural channels 30 are pressed over the top edges of box sides 13. The end reinforcement rail structural channels 31 are pressed over the top edges of box ends 12 and box end flaps 14. Next, the stacking lug structural corners 40 are placed over each tote box corner and pressed thereon. Legs 44 of stacking lug structural corners 40 are pressed over and encase end reinforcement rail structural channels 31, box ends 12, and box end flaps 14. Legs 45 of stacking lug structural corners 40 are pressed over and encase side reinforcement rail structural channels 30 and box sides 13.

Lastly, rivets 50 are attached through predrilled holes 51 in stacking lug structural corners 40. Rivets 50 which pass through legs 45 of stacking lug structural corners 40 bind those legs 45 to the side reinforcement rail structural channels 30 and box sides 13. Rivets 50 which pass through legs 44 of stacking lug structural corners 40 bind those legs 44 to the end reinforcement rail structural channels 31, box ends 12, and box end flaps 14. The corner enhancer structural angles 20 are of such a dimension that the rivets 50 do not pass through the corner enhancer structural angles 20. In other words, the length of a corner enhancer structural angle 20 is less than the height of a tote box 1 minus the distance which holes 51 reside below the top edges of box ends 12 and box sides 13.

While I have described yet one embodiment of my invention, those skilled in the art will recognize modifications and improvements which can be made to the invention without departing from the spirit or scope of the invention. For example, should the need dictate, a cover may be employed in the use of the invention. Accordingly, the invention is limited only by the appended claims.

What is claimed is:

1. A tote box comprising a box portion foldable from a box blank and having a bottom, two end walls, two side walls, and four end flaps which are extensions of said side walls, said end flaps being foldable about said end walls, said end walls and end flaps having holes into which are receivable hand holds, four corner enhancer structural angles, one of which resides within each inside corner of said box portion such that a first leg of each of said corner enhancer structural angles is sandwiched between said end wall and said end flap and a second leg of each of said corner enhancer structural angles resides against an inside surface of said side wall, four reinforcement rail structural channels, one of which is fitted over a top edge of each said side wall and said end wall, four stacking lug structural corners, one of which is fitted over said reinforcement rail structural channels at each corner of said tote box, and fastening means for fastening said stacking lug structural corners to said reinforcement rail structural channels, said side walls, said end walls, and said end flaps.

2. The tote box of claim 1 wherein said fastening means consists of rivets, said rivets passing through said stacking lug structural corners, said side walls, said end walls, and said end flaps, but not through said corner enhancer structural angles.

3. The tote box of claim 1 wherein said fastening means consists of rivets, there being at least two said rivets for each of said stacking lug structural corners.

4. A tote box comprising a box portion foldable from a box blank and having a bottom, two end walls, two side walls, and four end flaps which are extensions of said side walls, said end flaps being foldable about said end walls, four corner enhancer structural angles, one of which resides within each inside corner of said box portion such that a first leg of each of said corner enhancer structural angles is sandwiched between said end wall and said end flap and a second leg of each of said corner enhancer structural angles resides against an inside surface of said side wall, four reinforcement rail structural channels, one of which is fitted over a top edge of each said side wall and said end wall, four stacking lug structural corners, one of which is fitted over said reinforcement rail structural channels at each corner of said tote box, and fastening means for fastening said stacking lug structural corners to said reinforcement rail structural channels, said side walls, said end walls, and said end flaps.

5. The tote box of claim 4 wherein said fastening means consists of rivets, each of said rivets passing through said stacking lug structural corners, said side walls, said end walls, and said end flaps, but not through said corner enhancer structural angles.

6. A tote box comprising a box portion foldable from a box blank and having a bottom, two end walls, two side walls, and four end flaps which are extensions of said side walls, said end flaps being foldable about said end walls, four corner enhancer structural angles, one of which resides within each inside corner of said box portion such that a first leg of each of said corner enhancer structural angles is sandwiched between said end wall and said end flap and a second leg of each of said corner enhancer structural angles resides against an inside surface of said side wall, four reinforcement rail structural channels, one of which is fitted over a top edge of each said side wall and said end wall, and fastening means for fastening said reinforcement rail structural channels to said side walls, said end walls, and said end flaps.

7. The tote box of claim 6 wherein said fastening means consists of rivets, each of said rivets passing through said side walls, said end walls, and said end flaps, but not through said corner enhancer structural angles.

* * * * *